United States Patent [19]

Wach et al.

[11] Patent Number: 4,480,426

[45] Date of Patent: Nov. 6, 1984

[54] MATERIAL BAGGING DEVICE

[75] Inventors: Charles G. Wach, Oak Lawn; Robert E. Nelson, Lombard; Stephen B. Brak, Tinley Park, all of Ill.

[73] Assignee: The United States of America as represented by the United States Department of Energy, Washington, D.C.

[21] Appl. No.: 340,625

[22] Filed: Jan. 19, 1982

[51] Int. Cl.[3] ..... B65B 43/42

[52] U.S. Cl. ..... 53/576; 53/567; 17/49

[58] Field of Search ..... 17/35, 37, 38, 41; 53/567, 575, 576, 577

[56] References Cited

U.S. PATENT DOCUMENTS

| | | | |
|---|---|---|---|
| 872,231 | 11/1907 | Hambruch | 17/37 |
| 2,656,658 | 10/1953 | Grady | 53/576 |
| 3,938,300 | 2/1976 | Lövqvist | 53/576 |
| 4,023,238 | 5/1977 | Phares | 53/576 X |
| 4,064,673 | 12/1977 | Gerigk et al. | 17/41 X |
| 4,127,918 | 12/1978 | Trimble | 17/35 X |
| 4,292,711 | 10/1981 | Becker | 53/576 X |
| 4,307,489 | 12/1981 | Niedecker | 17/41 X |

FOREIGN PATENT DOCUMENTS

| | | | |
|---|---|---|---|
| 2087338 | 5/1982 | United Kingdom | 53/567 |
| 743665 | 6/1980 | U.S.S.R. | 17/35 |

*Primary Examiner*—R. L. Spruill
*Assistant Examiner*—Steven P. Weihrouch
*Attorney, Agent, or Firm*—Hugh W. Glenn; Robert J. Fisher; Michael F. Esposito

[57] ABSTRACT

A bagging device for transferring material from one chamber through an opening in a wall to a second chamber includes a cylindrical housing communicating with the opening and defining a passage between the chambers. A cylindrical cartridge is slidably received within the housing. The cartridge has a substantially rigid cylindrical sleeve to which is affixed a pliable tube. The pliable tube is positioned concentrically about the sleeve and has a pleated portion capable of unfolding from the sleeve and a closed end extending over a terminal end of the sleeve. Sealing means are interposed in sealed relationship between the cartridge and the housing. Material from one chamber is inserted into the cartridge secured in the housing and received in the closed end of the tube which unfolds into the other chamber enclosing the material therein. The tube may then be sealed behind the material and then severed to form a bag-like enclosure defined by the tube's closed terminal end and the new seal. The new seal then forms a terminal end for the unsevered portion of the pliable tube into which additional material may be placed and the bagging process repeated.

15 Claims, 4 Drawing Figures

MATERIAL BAGGING DEVICE

CONTRACTUAL ORIGIN OF THE INVENTION

The invention described herein was made in the course of, or under a contract with the U.S. Department of Energy vesting rights in the invention in the U.S. Government.

BACKGROUND OF THE INVENTION

The present invention relates generally to a bagging device and, more specifically, to a device for use in transferring contaminated material through a wall from a contaminated chamber to a clean chamber from which contaminated gas and dust are substantially excluded.

Considerable interest has been generated in the handling of contaminated substances. Contaminated substances must be transferred from one chamber to another without the release of the contaminating gas or material into the clean area. The movement of contaminated substances is further complicated by the necessity of using remote manipulators in areas of high level radiation.

In most cases contaminated materials are handled by means of plastic bags which are positioned in access ports by means of hose clamps requiring the use of a screwdriver for their attachment and release. Stretching a plastic bag over a port and adjusting the tension of a hose clamp in securing the bag to the port are difficult maneuvers when performed remotely with manipulators.

SUMMARY OF THE INVENTION

The present invention facilitates the handling of contaminated materials by means of remote plastic transfer bags wherein the operation of a remote manipulator is substantially simplified. In addition to increasing contaminated material handling safety, the present invention also reduces the frequency with which the bagging material must be replaced.

The bagging device of the present invention is designed for use in transferring contaminated material through a wall from a contaminated chamber to a clean chamber from which contaminated gas and dust are substantially excluded.

An embodiment of the present invention includes a port, or opening, passing through a wall separating the contaminated chamber from the clean chamber. A trough extends from the port into the contaminated chamber for receiving and guiding materials to be bagged and removed therefrom. A housing communicates with the port and includes a proximal end immediately adjacent thereto and a distal end extending into the clean chamber. The distal end of the housing includes hinged longitudinal sections capable of being opened to receive a tubular cartridge and closed in snuggly encompassing the cartridge. A flexible sleeve is positioned on the inner surface of the housing for substantially excluding contaminated gas or dust from entering the clean chamber through the clearance space between the housing and the cartridge.

A pliable tube having a sealed, closed end extending over a distal end portion of the cartridge is mounted on the sleeve. The pliable tube is capable of unfolding from the distal end portion of the cartridge into the clean chamber as contaminated material is pushed through the cartridge and into the tube. The tube can then be closed off in a conventional manner and sealed between the contaminated material and the wall separating the contaminated and clean areas. The tube is then severed along the seal and the enclosed contaminated material may be transported in the bag-like structure formed of the flexible tube. When the cartridge is substantially depleted of pliable tubing, the cartridge can be displaced in the housing by pusher means towards the contaminated chamber while remaining in sealed engagement with sphincteral sealing means. A new cartridge holding a pleated, pliable tube can then be positioned within the tubular compartment behind the old. As the new cartridge is positioned within the tubular compartment to engage the sphincteral sealing means, the original cartridge together with any unused bagging material is further pushed into the contaminated compartment. The re-lined compartment is once again prepared to receive contaminated material.

Other features and advantages of the present invention will be apparent from the following description and claims and are illustrated in the accompanying drawings which, by way of illustration, show a preferred embodiment of the present invention, the principles thereof and what is now considered to be the best mode in which to apply these principles. Other embodiments of the invention embodying the same or equivalent principles may be used and structural changes may be made as desired by those skilled in the art without departing from the present invention and the purview of the appended claims.

BRIEF DESCRIPTION OF THE DRAWINGS

FIG. 3 is a fragmentary sectional side perspective view of a bagging device incorporating the present invention showing the arrangement of the tubular cartridge and the pleated pliable tube.

DESCRIPTION OF THE PREFERRED EMBODIMENT

Figure 1:
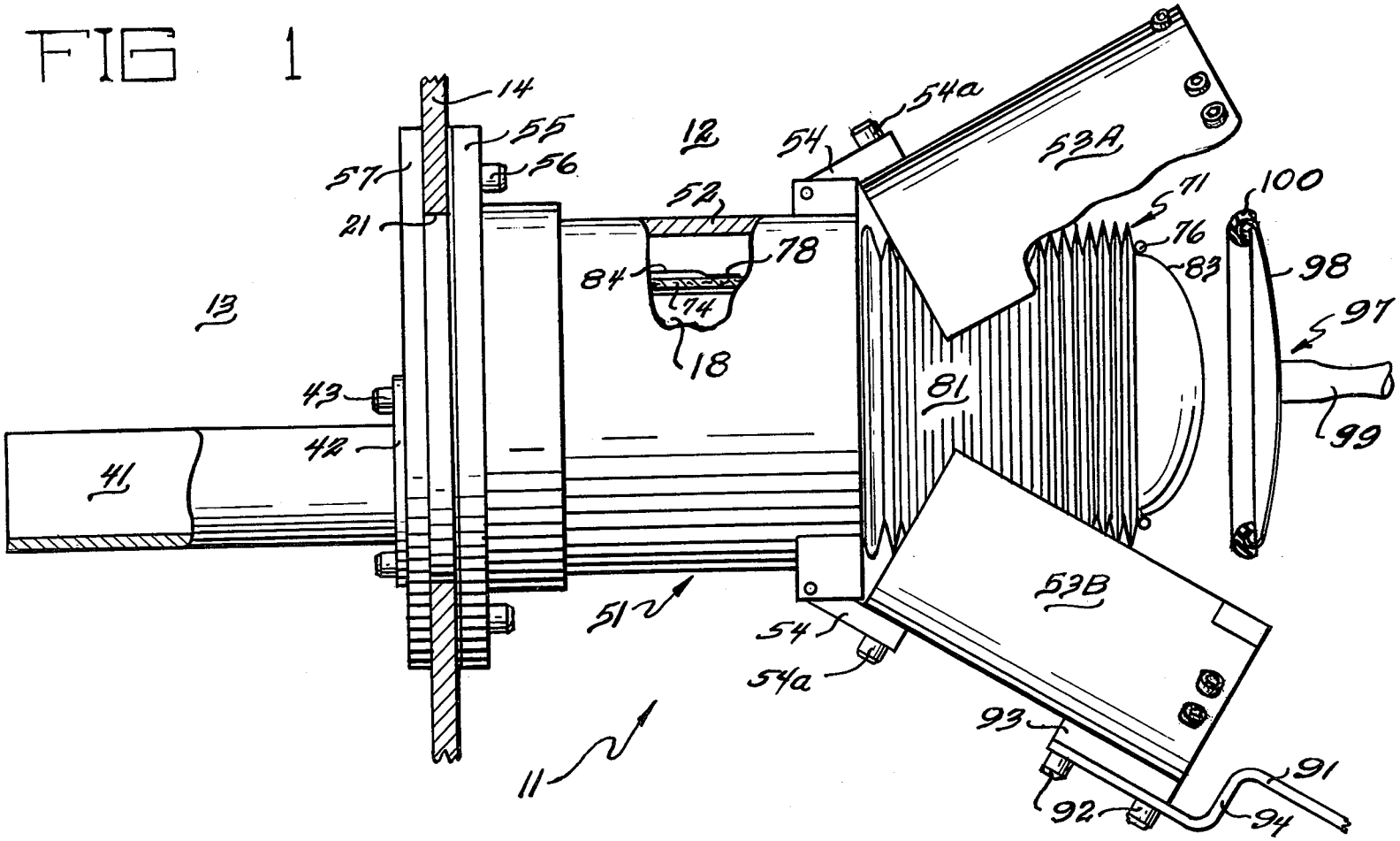
FIG. 1 is a fragmentary sectional side perspective view of a bagging device embodying the principles of the present invention.
Figure 2:
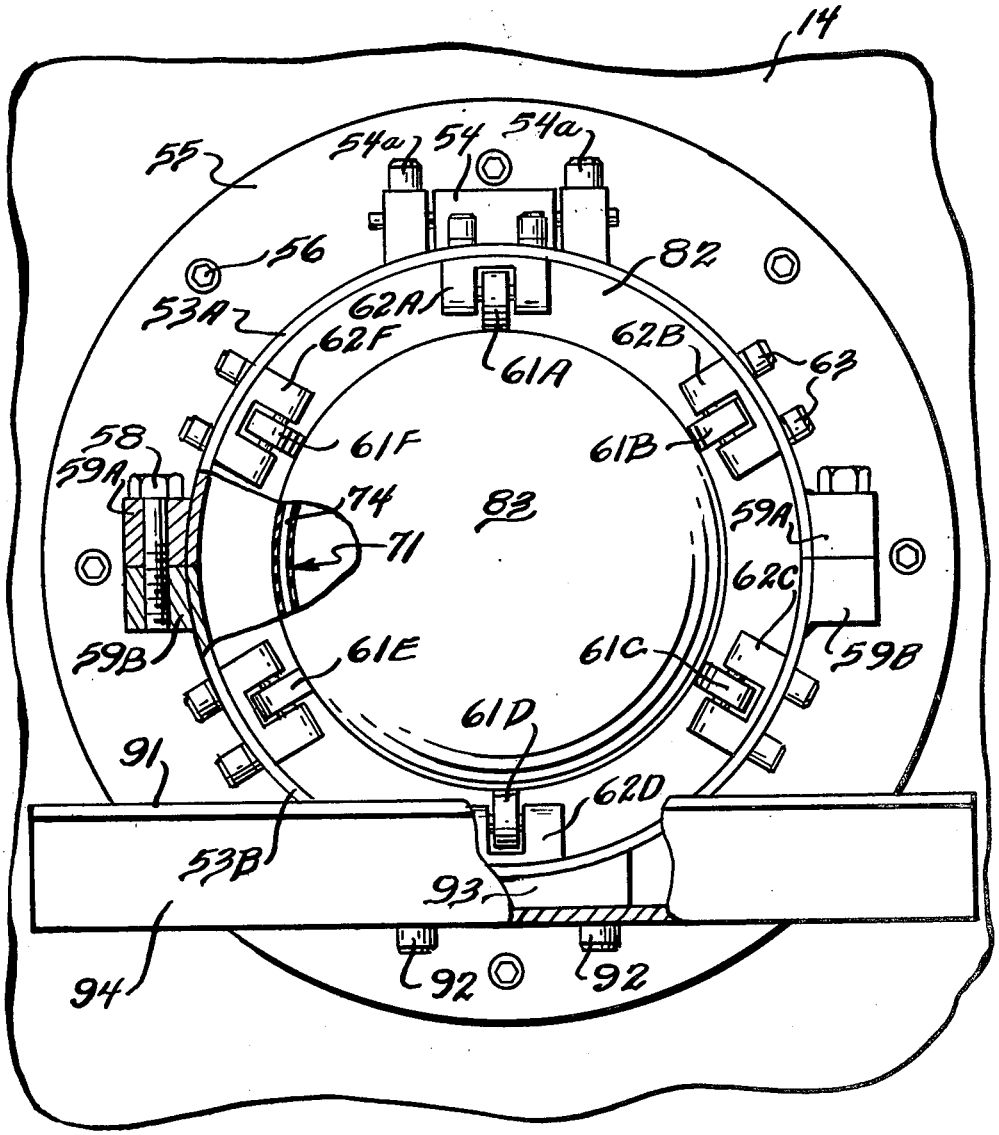
FIG. 2 is a front perspective view of a bagging device incorporating the present invention.

The present invention will be described in detail as a bagging device for transferring radioactive material from an area of high level radiation, to an area of low level radiation, with the understanding that the present disclosure is to be considered as an exemplification of the principles of the invention and is not intended to limit the embodiment illustrated. The bagging device of the subject invention generally designated by number 11, as best seen in FIGS. 1 and 2, is shown mounted on a wall 14 around an opening 21 which separates a first contaminated chamber 13 from a second clean chamber 12. The bagging device 11 is comprised of the following elements: a housing 51, a sleeve 74 and a pliable tube 81.

The housing 51, sleeve 74 and tube 81 may have any cross-sectional shape, however, it is relatively easy to obtain a sealed relationship between the components of the present invention when they have a circular cross-sectional shape. Therefore the bagging device of the present invention is described with regard to a bagging device where the major elements have a circular cross-sectional shape.

The cylinder housing 51 communicates with the opening 21 and extends into the clean chamber 12. The housing 51 has a proximal end 52 and a distal end 53 with respect to wall 14 and further defines a passage 18 extending from the contaminated chamber 13 to the clean chamber 12. The housing 51 is secured to the wall 14 by means of a flange 55 secured to the proximal end 52 by suitable means such as welding and affixed to the wall 14 by means of bolts 56 extending through holes in the flange 55 and the wall 14 and threadably received into holes in retaining plate 57. The distal end 53 of the housing 51 is divided longitudinally into an upper section 53A and a lower section 53B. The split distal end 53 is affixed to the sealed, proximal end 52 by means of hinges 54 which allow the upper and lower sections 53A, 53B to open and close in a jaw-like manner.

Figure 4:
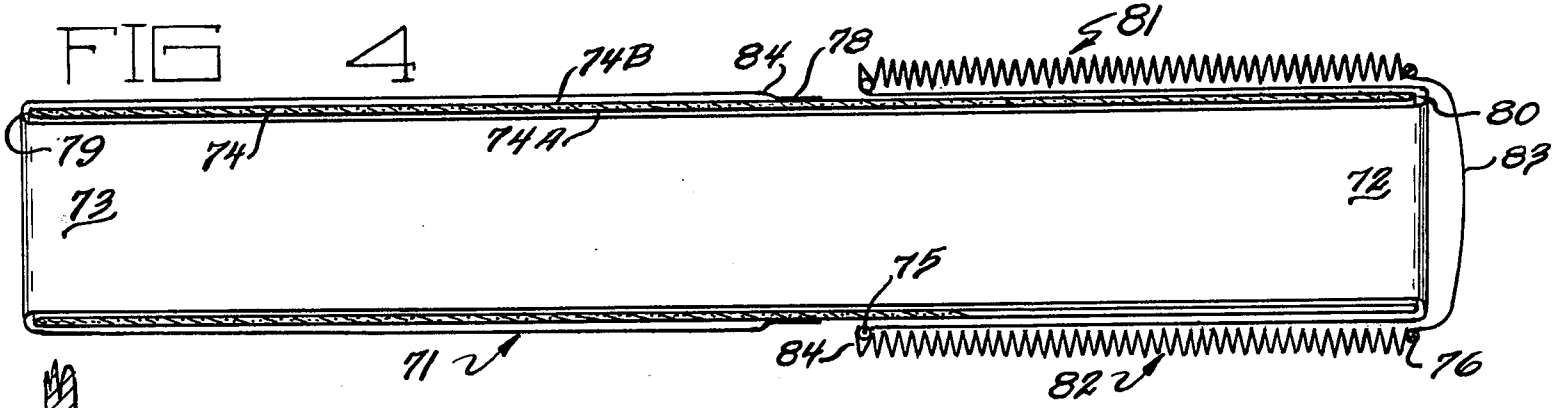
FIG. 4 is a fragmentary sectional side view of a tubular cartridge embodying principles of the present invention.
Figure 5:
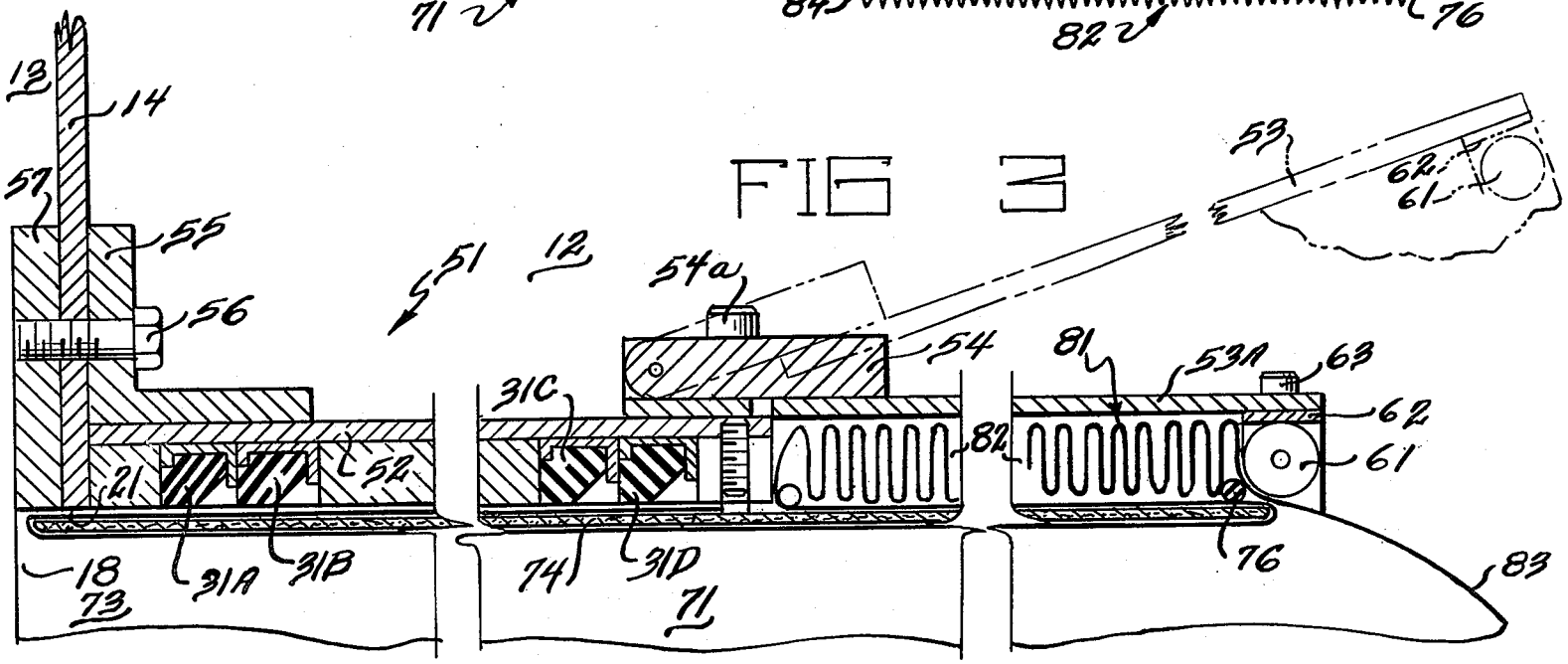

Referring to FIG. 4, a cylindrical cartridge 71 is insertably received in the housing 51. The cartridge 71 also has a distal end 72 and a proximal end 73 with respect to wall 14. The cartridge 71 has a cylindrical sleeve 74 having an inner surface 74A and an outer surface 74B, and a proximal end 79 and a distal end 80 with respect to wall 14 corresponding to those of cartridge 71. A pliable tube 81 has a closed distal end 83 and an open proximal end 84. The pliable tube 81 is secured at its proximal end 84 to an intermediate portion of the outer surface 74B of the cylindrical sleeve 74 by securing means such as electrical tape 78.

The pliable tube 81 extends around the sleeve proximal end 79 and runs the length of the sleeve inner surface 74A. Wrapping around sleeve distal end 80, the pliable tube comes back along the outer surface 74B to an intermediate portion where it is secured by means of an O-ring 75. From the O-ring 75 the pliable tube 81 extends forward in a collapsed configuration to permit its accordian-like linear expansion. The pliable tube 81 includes a plurality of pleats in alternating sections of narrow and wide diameters compressed together in folds. The pleated portion 82 of the pliable tube 81 extends back to the distal end 80 of the sleeve 74 where it is secured by means of a resilient O-ring retainer 76 removably affixed to the sleeve 74. The O-ring retainer prevents the pleated portion 82 from expanding outward off the sleeve 74. The pliable tube extends over the sleeve 74 to a closed distal end 83.

Referring now to FIG. 3, the cartridge 71 is shown received within the housing 51 in passage 18. The split section 53 is in closed relationship around the pleated portion 82 of the pliable tube 81. The pleated portion 82 of the pliable tube 81 is retained within split section 53 and on the sleeve 74 by dispensing means in the form of retaining wheels 61 attached to the distal end of the split section 53 by means of brackets 62 secured to the wall of split section 53 by bolts 63. Once the pleated portion 82 of the pliable tube 81 is secured by the retaining wheels 61, the O-ring retainer 76 is no longer needed and can be removed.

The proximal portion 73 of cartridge 71 is received within the sealed section 52 of housing 51. Sealing means include proximal sphincter seals 31A and 31B and distal sphincter seals 31C and 31D. The sphincter seals 31A through 31D permit the cartridge 71 to slide into housing 51 from the clean chamber 12, while opposing movement of the cartridge 71 in the opposite direction. The seals 31A through 31D are affixed to and extend around the inner wall of the sealed section 52 of housing 51. Proximal seals 31A and 31B are positioned in the vicinity of wall 14, while distal seals 31C and 31D are positioned toward split section 53. The seals 31A through 31D sealably engage cartridge 71 to prevent the escape of gas or dust from the space between cartridge 71 and housing 51.

Referring now to FIG. 2, the pleated portion 82 of tube 81 is retained within the housing 51 by dispensing means. Dispensing means include discharge wheels 61A, 61B, 61C, 61D, 61E and 61F which are secured to the inner wall of housing 51 by means of brackets 62A, 62B, 62C, 62D, 62E and 62F, respectively, which are, in turn, secured to the inner wall of the distal end 53 of housing 51 by bolts 63.

Referring to FIGS. 2 and 3, the upper and lower halves 53A and 53B of split section 53 are secured together in closed relationship by means of hinges 54 to form a cylinder with flange 59A secured to the upper half 53A of the split section by suitable means such as welding. A bottom flange 59B is similarly affixed to the lower half of the split section 53. A bolt 58 extends through the upper flange 59A and is threadably received within the lower flange 59B to secure the upper and lower halves 53A and 53B together.

Referring now to FIGS. 1 and 2, a platform 91 having a flat surface is aligned with the bottom of the distal end of sleeve 74. A substantially S-shaped support section 94 couples the platform 91 to a bracket 93 attached to the lower half 53B of split section 53 by bolts 92. The platform 91 swings down with the lower half of split section 53.

The platform 91 provides a convenient flat support surface for material passing through housing 51 and sleeve 74 and for the withdrawing of pliable tube 81 from cartridge 71. While the material and pliable tube 81 are supported on the platform 91, the pliable tube 81 may be sealed at two different positions along its length. Tube 81 may then be severed between the two seals with the contaminated material remaining within the sealed portion of pliable tube 81. The seal on the proximal portion of tube 81 attached to cylindrical sleeve 74 forms a new closure 83 and the tube can receive additional material. A sealed relationship between chambers 12 and 13 is maintained and the contaminated material is enclosed in a bag-like structure. Alternatively, a wide strip of pliable tube may be sealed and then severed across the wide seal, creating a new closure and enclosing the material in a bag-like structure.

Referring again to FIG. 1, trough 41, extending outwardly from the wall 14 into the contaminated chamber 13, is aligned with the passage 18 defined by housing 51. Flange 42 is secured to trough 41 by suitable means such as welding. Bolts 43 extend through holes in flange 42 and are threadably received by the holes in retaining plate 57 to secure trough 41 to the housing 51. Trough 41 provides a support and guide surface for objects and materials to be received through opening 21 in wall 14 and into housing 51.

A push bar 97 facilitates the removal or installation of cartridges 71. Push bar 97 has a cartridge engaging means 98 at one end, and a handle means 99 at the other end. A cushioning material 100 covers the outer rim of cartridge engaging means 98 and prevents push bar 97 from binding, cutting or tearing any portion of the pliable tube 81 which may become caught between the engaging means 98 and the inner surface of housing 51. Push bar 97 is forced through housing 51, pushing the depleted cartridge 71 towards the proximal end 52 of housing 51 until the portion of sleeve 74 formerly adjacent to the pleated portion 82 of pliable tube 81 is engaged with the proximal sphincter seal 31A and 31B. A new cartridge can then be inserted into housing 51 in sealed engagement with distal sphincter seals 31C and 31D.

In operation, contaminated material is supported and guided by trough 41 as it passes through opening 21 in wall 14 and into cartridge 71. The material is forced through the cartridge 71 until it reaches the closed end 83 of pliable tube 81. The pleated portion 82 of pliable tube 81 is released from the sleeve 74 by discharge wheels 61A through 61F mounted about distal end 53 of housing 51. The contaminated material and a portion of pliable tube 81 are supported on the platform 91 as the material and tube 81 extend out of housing 51. While the contaminated material is supported on the platform 91, the pliable tube 81 behind the contaminated material is closed and sealed at two different points along the length of the tube. Pliable tube 81 is severed between the two new seals leaving the contaminated material in a sealed, separated bag-like portion of the pliable tube. The remainder of the pliable tube 81 remains sealed to the movement of contaminated gas from contaminated chamber 13 to clean chamber 12.

When the pleated portion 82 of pliable tube 81 is depleted from the tubular cartridge 71, push bar 97 is used to push cartridge 71 toward the proximal end 52 of housing 51 such that the proximal end 73 of cartridge 71 extends out into the contaminated chamber 13 and the portion of the sleeve 74 towards its distal end 83 is engaged in proximal seals 31A and 31B.

The push bar 97 is withdrawn and the split section 53 is opened swinging platform 91 and the discharge wheels 61A through 61F mounted thereon apart to allow the entry of a new cartridge 71 into housing 51. The portion of the cartridge 71 toward wall 14 is engaged in the distal seals 31C and 31D. Thus, at all times dust and air from the contaminated chamber 13 is prevented from entering the clean chamber 12 through opening 21.

The engaging means 98 of the push bar 97 is used to force the new cartridge 71 further into the housing 51. As the new cartridge 71 moves toward wall 14 and engages proximal seals 31A and 31B, it forces the old cartridge 71 into trough 41 where it may be readily removed. The pleated portion 82 of pliable tube 81 is retained upon cylindrical sleeve 74 by means of an O-ring retainer 76. After the cartridge 71 is positioned within the housing 51, the two halves 53A and 53B of split section 53 can be closed and secured by bolts 58 and flanges 59A and 59B. When closed, the discharge wheels 61A through 61F prevent pleated portion 82 of the pliable tube 81 from unfolding and extending beyond the housing 51. The bagging device 11 is then ready for receiving contaminated material again from the contaminated chamber 13 for transfer to the clean chamber 12.

From the foregoing, it will be seen that the present invention provides a safe means for remotely handling contaminated materials. The flexible bagging material within which the contaminants are enclosed for handling, transport, etc., is easily replaced in the present invention for subsequent material handling. In addition, the present invention increases the number of transfers between the contaminated and clean areas before replacement of the bagging material is required. Thus, while the preferred embodiment of the invention has been illustrated and described, it is understood that this is capable of variation and modification, and therefore the present invention should not be limited to the precise details set forth, but should include such changes and alterations as fall within the purview of the following claims.

The embodiments of the invention in which an exclusive property or privilege is claimed are defined as follows:

1. A bagging device for remotely transferring material from a first contaminated chamber through an opening in a wall to a second clean chamber, said bagging device comprising:

a housing attached to said wall in communicating alignment with said opening and extending into said second clean chamber, said housing having an open proximal and a closed distal end relative to said wall;

an open-ended cartridge positioned within and in close proximity to said housing, said cartridge having proximal and distal ends corresponding to those of said housing and inner and outer surfaces;

a flexible tube sealably positioned on the inner and outer surfaces of said cartridge and including:

a closed end positioned adjacent and in sealing relation to the distal end of said cartridge; and an extendible portion coupled to said closed end and slidably positioned on the outer, distal portion of said cartridge in sealed relation thereto;

said tube adapted to receive material from said first contaminated chamber through said opening in said wall and to be extendibly displaced from the distal portion of said cartridge in response to the further displacement of said material against the closed end of said tube wherein a proximal portion of said tube may be sealably severed in securing said material in said closed tube while providing another closed end portion of tube in said cartridge for receiving additional material without subjecting said second clean chamber to the contamination of said first chamber; and sealing means interposed in sealed engagement between said housing and said cartridge and extending around the inner circumference of said housing and sealably engaging said cartridge in permitting movement of said cartridge towards said first chamber but resisting movement of said cartridge towards said second chamber in allowing a tube depleted cartridge to be discharged into said first chamber while resisting the withdrawal of said cartridge into said second chamber when material is being deposited in said tube.

2. The bagging device of claim 1 wherein said extendible portion of said flexible tube includes a plurality of pleats of alternating narrow and wide bands in a linearly collapsed arrangement permitting the closed end of said tube to be displaced from the distal end of said cartridge while maintaining sealing engagement between said tube and said cartridge.

3. The bagging device of claim 1 further comprising tube dispensing means affixed to the distal end of said housing to restrain said flexible tube from expanding outwardly from the distal end of said cartridge without a displacement force applied to the closed end of said tube.

4. The bagging device of claim 3 wherein said tube dispensing means includes a plurality of rollers projecting inwardly about the circumference of the distal end of said housing in close proximity to said cartridge for restraining said tube from extending outwardly from the distal end of said cartridge whereby the rotation of said rollers releases said tube allowing it to be withdrawn by the outward displacement of material against the closed end of said tube.

5. The bagging device of claim 1 further comprising trough means in said first chamber in communicating alignment with said opening and extending into said second chamber for guiding material into said housing for deposit in said tube.

6. The bagging device of claim 1 wherein the distal portion of said housing opens radially outwardly to receive said cartridge and flexible tube combination and closes therearound to facilitate the loading of a new cartridge and flexible tube combination in said housing.

7. The bagging device of claim 1 further comprising a platform extending distally from and coupled to said housing and having an upper surface aligned with a bottom portion of said cartridge to receive said flexible tube and material therein as said tube is extended out of said housing, said platform providing a surface to seal and sever a portion of said pliable tube.

8. The bagging device of claim 1 wherein said sealing means comprises a plurality of sphincteral seals extending around the inner circumference of said housing and sealably engaging said cartridge, said sphincteral seals allowing movement of said cartridge towards said first chamber but resisting movement of said cartridge towards said second chamber, said sphincteral seals allowing a tube depleted cartridge to be discharged into said first chamber and resisting the withdrawal of said cartridge into said second chamber when material is being deposited in said tube.

9. The bagging device of claim 8 wherein said plurality of sphincteral seals include proximal sphincteral seals and distal sphincteral seals, wherein a tube-depleted cartridge is removed from said housing by inserting a replacement cartridge in the open distal end of said housing and displacing said depleted cartridge toward said opening and into said first chamber while maintaining isolation between said first and second chambers by means of the sequential sealing engagement of said depleted and replacement cartridges with said proximal and distal sphincteral seals.

10. The bagging device of claim 1 further comprising pusher means adapted for insertion within and displacement along said housing from the distal end thereof, said pusher means including a cartridge engaging surface mounted to an extending arm for engaging said cartridge when said cartridge is substantially depleted of flexible tube with the proximal displacement of said extending arm along and within said housing causing said cartridge to move toward said opening.

11. The bagging device of claim 10 further comprising cushion means extending around the circumference of said cartridge engaging surface to prevent the binding and tearing of said flexible tube by the displacement of said cartridge engaging surface.

12. The bagging device of claim 6 wherein the radially outwardly opening distal portion of said housing includes upper and lower longitudinal sections, said sections rotatably coupled to an adjacent proximal portion of said housing and in swinging engagement therewith to facilitate cartridge insertion in said housing.

13. A bagging device for remotely transferring material from a first contaminated chamber through an opening in a wall to a second clean chamber, said bagging device comprising:

a housing attached to said wall in communicating alignment with said opening and extending into said second clean chamber, said housing having an open proximal and a closed distal end relative to said wall;

an open-ended cartridge positioned within and in close proximity to said housing, said cartridge having proximal and distal ends corresponding to those of said housing and inner and outer surfaces;

a flexible tube sealably positioned on the inner and outer surfaces of said cartridge and including:

a closed end positioned adjacent and in sealing relation to the distal end of said cartridge; and an extendible portion coupled to said closed end and slidably positioned on the outer, distal portion of said cartridge in sealed relation thereto, said extendible portion including a plurality of pleats of alternating narrow and wide bands in a linearly collapsed arrangement permitting the closed end of said tube to be displaced from the distal end of said cartridge while maintaining sealing engagement between said tube and said cartridge, said tube adapted to receive material introduced into said housing from said first contaminated chamber through said opening in said wall and to be extendibly displaced from the distal portion of said cartridge in response to the further displacement of said material against the closed end of said tube wherein a proximal portion of said tube may be sealably severed in securing said material in said closed tube while providing another closed end portion of tube in said cartridge for receiving additional material without subjecting said second clean chamber to the contamination of said first chamber;

tube dispensing means affixed to the distal end of said housing to restrain said flexible tube from expanding outwardly from the distal end of said cartridge without a displacement force applied to the closed end of said tube;

trough means in said first chamber in communicating alignment with said opening and extending into said second chamber for guiding material into said housing; and sealing means interposed in sealed engagement between said housing and said cartridge and extending around the inner circumference of said housing and sealably engaging said cartridge in permitting movement of said cartridge towards said first chamber but resisting movement of said cartridge towards said second chamber in allowing a tube depleted cartridge to be discharged into said first chamber while resisting the withdrawal of said cartridge into said second chamber when material is being deposited in said tube.

14. A bagging device for remotely transferring material from a first contaminated chamber through an opening in a wall to a second clean chamber, said bagging device comprising:

an open-ended cartridge having a proximal end and a distal end relative to said wall and inner and outer surfaces;

a flexible tube sealably positioned on the inner and outer surfaces of said cartridge and including:

a closed end positioned adjacent and in sealing relation to the distal end of said cartridge; and an extendible portion coupled to said closed end and slidably positioned on the outer, distal portion of said cartridge in sealed relation thereto;

a housing attached to said wall in communicating alignment with said opening having proximal and distal ends corresponding to those of said cartridge and extending into said second clean chamber, the distal end of said housing including upper and lower longitudinal sections, said sections rotatably coupled to an adjacent proximal portion of said housing and in hinged engagement therewith to receive the cartridge and tube combination and close therearound in facilitating the loading thereof in said housing;

sealing means interposed in sealed engagement between said housing and said cartridge and extending around the inner circumference of said housing and sealably engaging said cartridge in permitting movement of said cartridge towards said first chamber but resisting movement of said cartridge towards said second chamber in allowing a tube depleted cartridge to be discharged into said first chamber while resisting the withdrawal of said cartridge into said second chamber when material is being deposited in said tube;

a platform extending distally from and coupled to said housing and having an upper surface aligned with the bottom of said cartridge to receive said flexible tube and material therein as said tube is extended out of said housing, said platform providing a surface to seal and sever a portion of said flexible tube; and trough means in said first chamber in communicating alignment with said opening and extending into said second chamber for guiding material into said housing;

said tube adapted to receive material introduced into said housing from said first contaminated chamber through said opening in said wall and to be extendibly displaced from the distal portion of said cartridge in response to the further displacement of said material against the closed end of said tube wherein a proximal portion of said tube may be sealably severed on said platform in securing said material in said closed tube while providing another closed end portion of tube in said cartridge for receiving additional material without subjecting said second clean chamber to the contamination of said first chamber.

15. A bagging device for remotely transferring material from a first contaminated chamber through an opening in a wall to a second clean chamber, said bagging device comprising:

a housing attached to said wall in communicating alignment with said opening and extending into said second clean chamber, said housing having an open proximal and a closed distal end relative to said wall;

an open-ended cartridge positioned within and in close proximity to said housing, said cartridge having proximal and distal ends corresponding to those of said housing and inner and outer surfaces;

sealing means interposed in sealed engagement between said housing and said cartridge, said sealing means including a plurality of sphincteral seals extending around the inner circumference of said housing and sealably engaging said cartridge, said sphincteral seals allowing movement of said cartridge towards said first chamber but resisting movement of said cartridge towards said second chamber;

a flexible tube sealably positioned on the inner and outer surfaces of said cartridge and including:

a closed end positioned adjacent and in sealing relation to the distal end of said cartridge; and an extendible portion coupled to said closed end and slidably positioned on the outer, distal portion of said cartridge in sealed relation thereto;

pusher means adapted for insertion within and displacement along said housing from the distal end thereof, said pusher means including a cartridge engaging surface mounted to an extending arm for engaging said cartridge when said cartridge is substantially depleted of flexible tube with the proximal displacement of said extending arm along and within said housing causing said cartridge to move toward said opening, said cartridge engaging surface having cushion means extending around the circumference thereof to prevent the binding and tearing of said flexible tube due to the displacement of said cartridge engaging surface; and trough means in said first chamber in communicating alignment with said opening and extending into said second chamber for guiding material into said housing;

said tube adapted to receive material introduced into said housing from said first contaminated chamber through said opening in said wall and to be extendibly displaced from the distal portion of said cartridge in response to the further displacement of said material against the closed end of said tube wherein a proximal portion of said tube may be sealably severed in securing said material in said closed tube while providing another closed end portion of tube in said cartridge for receiving additional material without subjecting said second clean chamber to the contamination of said first chamber.

* * * * *